US005744434A

United States Patent [19]

Schlosberg et al.

[11] Patent Number: 5,744,434

[45] Date of Patent: *Apr. 28, 1998

[54] POLYOL ESTER COMPOSITIONS WITH UNCONVERTED HYDROXYL GROUPS

[75] Inventors: Richard Henry Schlosberg, Bridgewater; Haven S. Aldrich, Westfield, both of N.J.; Lavonde Denise Sherwood-Williams, Baton Rouge, La.; John S. Szobota, Morristown, N.J.; Martin Anthony Krevalis, Baton Rouge, La.; Daniel P. Leta, Flemington, N.J.; David Gary Lawton Holt, Brights Grove, Canada; Fay H. Gordon, Oxford, England

[73] Assignee: Exxon Chemical Patents Inc., Houston, Tex.

[ * ] Notice: The term of this patent shall not extend beyond the expiration date of Pat. No. 5,665,686.

[21] Appl. No.: 615,380

[22] Filed: Mar. 14, 1996

Related U.S. Application Data

[63] Continuation-in-part of Ser. No. 403,366, Mar. 14, 1995.

[51] Int. Cl.[6] ..... C10M 129/74

[52] U.S. Cl. ..... 508/485; 508/492; 508/495

[58] Field of Search ..... 508/485, 492, 508/495

[56] References Cited

U.S. PATENT DOCUMENTS

| | | | |
|---|---|---|---|
| 3,115,519 | 12/1963 | Crouse et al. . | |
| 3,441,600 | 4/1969 | Chao et al. | 508/485 |
| 3,562,300 | 2/1971 | Chao et al. . | |
| 3,694,382 | 9/1972 | Klein et al. . | |
| 4,049,563 | 9/1977 | Burrous . | |
| 4,053,491 | 10/1977 | Koch et al. . | |
| 4,113,635 | 9/1978 | Sakurai et al. . | |
| 4,113,642 | 9/1978 | Koch et al. . | |
| 4,144,183 | 3/1979 | Koch et al. . | |
| 4,175,046 | 11/1979 | Coant et al. . | |
| 4,175,047 | 11/1979 | Schick et al. . | |
| 4,292,187 | 9/1981 | Hentschel et al. . | |
| 4,336,176 | 6/1982 | Lindner . | |
| 4,362,636 | 12/1982 | Small, Jr. . | |
| 4,370,248 | 1/1983 | Horodysky et al. . | |
| 4,421,886 | 12/1983 | Worschech et al. . | |
| 4,440,657 | 4/1984 | Metro et al. . | |
| 4,504,385 | 3/1985 | Keys . | |
| 4,614,604 | 9/1986 | Helfert et al. . | |
| 4,734,211 | 3/1988 | Kennedy . | |
| 4,753,743 | 6/1988 | Sech . | |
| 4,764,296 | 8/1988 | Kennedy . | |
| 4,820,431 | 4/1989 | Kennedy | 508/485 |
| 4,938,881 | 7/1990 | Ripple et al. . | |
| 4,957,649 | 9/1990 | Ripple et al. . | |

(List continued on next page.)

FOREIGN PATENT DOCUMENTS

| | | |
|---|---|---|
| 854728 | 9/1960 | Canada . |
| 458584 | 5/1990 | European Pat. Off. . |
| 0 573 231 | 5/1993 | European Pat. Off. . |
| 0571091 | 11/1993 | European Pat. Off. . |
| A-612832 | 8/1994 | European Pat. Off. . |
| A-646638 | 4/1995 | European Pat. Off. . |
| 05017790-A | 9/1991 | Japan . |
| A-1158386 | 7/1969 | United Kingdom . |
| A-1264897 | 2/1972 | United Kingdom . |

*Primary Examiner*—Jacqueline V. Howard
*Attorney, Agent, or Firm*—Richard D. Jordan

[57] ABSTRACT

A synthetic ester composition which exhibits thermal and oxidative stability, lower friction coefficient and lower wear, wherein the ester composition comprises the reaction product of: a branched or linear alcohol having the general formula $R(OH)_n$, wherein R is an aliphatic or cyclo-aliphatic group having from about 2 to 20 carbon atoms and n is at least 2; and at least one branched mono-carboxylic acid which has a carbon number in the range between about $C_5$ to $C_{13}$; wherein the synthetic ester composition has between about 5–35% unconverted hydroxyl groups, based on the total amount of hydroxyl groups in the branched or linear alcohol.

46 Claims, 6 Drawing Sheets

U.S. PATENT DOCUMENTS 4,959,169 9/1990 McGraw et al. .
5,057,247 10/1991 Schmid et al. .
5,064,546 11/1991 Dasai .
5,185,092 2/1993 Fukuda et al. .
5,211,884 5/1993 Bunemann et al. .
5,273,672 12/1993 Dasai et al. .
5,374,303 12/1994 van Hoorn .
5,403,503 4/1995 Seiki et al. .
5,447,563 9/1995 van Hoorn .

POLYOL ESTER COMPOSITIONS WITH UNCONVERTED HYDROXYL GROUPS

This is a continuation-in-part application of Ser. No. 08/403,366, filed on Mar. 14, 1995.

The present invention generally relates to polyol ester compositions which exhibit enhanced thermal/oxidative stability, lower friction coefficient and lower wear compared to conventional synthetic esters. In particular, the unique polyol esters of the present invention have unconverted hydroxyl groups from the reaction product of a polyol with a branched acid, thereby allowing the unconverted hydroxyl groups to be used to substantially delay the onset of oxidative degradation versus fully esterified polyol esters. The present invention also reduces or eliminates the amount of antioxidant which is required to attain an acceptable level of thermal/oxidative stability based upon a given amount of polyol ester.

BACKGROUND OF THE INVENTION

Lubricants in commercial use today are prepared from a variety of natural and synthetic base stocks admixed with various additive packages and solvents depending upon their intended application. The base stocks typically include mineral oils, highly refined mineral oils, poly alpha olefins (PAO), polyalkylene glycols (PAG), phosphate esters, silicone oils, diesters and polyol esters.

One of the most demanding lubricant applications in terms of thermal and oxidative requirements is aircraft turbine oils. Polyol esters have been commonly used as base stocks in aircraft turbine oils. Despite their inherent thermal/oxidative stability as compared with other base stocks (e.g., mineral oils, polyalphaolefins, etc.), even these synthetic ester lubricants are subject to oxidative degradation and cannot be used, without further modification, for long periods of time under oxidizing conditions. It is known that this degradation is related to oxidation and hydrolysis of the ester base stock.

Conventional synthetic polyol ester aircraft turbine oil formulations require the addition of antioxidants (also known as oxidation inhibitors). Antioxidants reduce the tendency of the ester base stock to deteriorate in service which deterioration can be evidenced by the products of oxidation such as sludge and varnish-like deposits on the metal surfaces, and by viscosity and acidity growth. Such antioxidants include arylamines (e.g., dioctyl phenylamine and phenylalphaniaphthylamine), and the like.

Frequently replacing the aircraft turbine oil or adding an antioxidant thereto to suppress oxidation increases the total cost of maintaining aircraft turbines. It would be most desirable to have an ester base stock which exhibits substantially enhanced thermal/oxidative stability compared to conventional synthetic ester base stocks, and wherein the ester base stock does not require frequent replacement due to decomposition (i.e., oxidation degradation). It would also be economically desirable to eliminate or reduce the amount of antioxidant which is normally added to such lubricant base stocks.

Upon thermal oxidative stress a weak carbon hydrogen bond is cleaved resulting in a unstable carbon radical on the ester. The role of conventional antioxidants is to transfer a hydrogen atom to the unstable carbon radical and effect a "healing" of the radical. The following equation demonstrates the effect of antioxidants (AH):

$$AH + ROO\bullet \rightarrow A\bullet + ROOH$$

The antioxidant molecule is converted into a radical, but this radical (A●) is far more stable than that of the ester-based system. Thus, the effective lifetime of the ester is extended. When the added antioxidant is consumed, the ester radicals are not healed and oxidative degradation of the polyol ester composition occurs. One measure of relative thermal/oxidative stability well known in the art is the use of high pressure differential scanning calorimetry (HPDSC).

HPDSC has been used to evaluated the thermal/oxidative stabilities of formulated automotive lubricating oils (see J. A. Walker, W. Tsang, SAE 801383), for synthetic lubricating oils (see M. Wakakura, T. Sato, Journal of Japanese Petroleum Institute, 24 (6), pp. 383–392 (1981)) and for polyol ester derived lubricating oils (see A. Zeeman, Thermochim, Acta, 80(1984)1). In these evaluations, the time for the bulk oil to oxidize was measured which is the induction time. Longer induction times have been shown to correspond to oils having higher concentrations of antioxidants or correspond to oils having more effective antioxidants or at a fixed level of a given antioxidant, have been shown to correspond to oils having intrinsically more stable base stocks. For automotive lubricants, higher induction times have been correlated with viscosity break point times.

The use of HPDSC as described herein provides a measure of stability through oxidative induction times. A polyol ester can be blended with a constant amount of dioctyl diphenylamine which is an antioxidant. This fixed amount of antioxidant provides a constant level of protection for the polyol ester base stock against bulk oxidation. Thus oils tested in this manner with longer induction times have greater intrinsic resistance to oxidation. For the high hydroxyl esters in which no antioxidant has been added, the longer induction times reflect the greater stability of the base stock by itself and also the natural antioxidancy of the esters due to the free hydroxyl group.

The present inventors have developed a unique polyol ester composition having enhanced thermal/oxidative stability when compared to conventional synthetic polyol ester compositions. This was accomplished by synthesizing a polyol ester composition from a polyol and branched acid or branched/linear acid mixture in such a way that it has a substantial amount of unconverted hydroxyl groups. Having a highly branched polyol ester backbone permits the high hydroxyl ester to act similarly to an antioxidant, i.e., cause the thermal/oxidative stability of the novel polyol ester composition to drastically increase, as measured by high pressure differential scanning calorimetry (HPDSC). That is, this novel polyol ester composition provides an intramolecular mechanism which is capable of scavenging alkoxide and alkyl peroxide radicals, thereby substantially reducing the rate at which oxidative degradation can occur.

The thermal and oxidative stability which is designed into the novel polyol ester compositions of the present invention eliminates or reduces the level of antioxidant which must be added to a particular lubricant, thereby providing a substantial cost savings to lubricant manufacturers.

The present inventors have also discovered that these unique high hydroxyl polyol esters exhibit beneficial friction and wear effects in crackcase engine lubricant application. Finally, the novel high hydroxyl polyol esters of the present invention provide exhibits enhanced fuel savings versus either no ester additive or fully esterified synthetic esters.

The present invention also provides many additional advantages which shall become apparent as described below.

SUMMARY OF THE INVENTION

A synthetic ester composition exhibiting thermal and oxidative stability which comprises the reaction product of:

a branched or linear alcohol having the general formula $R(OH)_n$, wherein R is an aliphatic or cyclo-aliphatic group having from about 2 to 20 carbon atoms and n is at least 2; and at least one branched mono-carboxylic acid which has a carbon number in the range between about $C_5$ to $C_{13}$; wherein the synthetic ester composition has between about 5–35% unconverted hydroxyl groups, based on the total amount of hydroxyl groups in the branched or linear alcohol.

Preferably, the branched or linear alcohol is present in an excess of about 10 to 35 equivalent percent for the amount of the branched acid or branched/linear mixed acids used. Between about 60 to 90% of the hydroxyl groups from the branched or linear alcohol are converted upon the esterification of the branched or linear alcohol with the acid. The resultant synthetic polyol ester composition according to the present invention exhibits a thermal/oxidative stability measured by HPDSC at 220° C., 3.445 MPa air and 0.5 wt. % Vanlube® 81 antioxidant (i.e., dioctyl diplhenyl amine) of greater than 50 minutes, preferably greater than 100 minutes.

The polyol ester composition comprises at least one of the following compounds: $R(OOCR')_n$, $R(OOCR')_{n-1}OH$, $R(OOCR')_{n-2}(OH)_2$, and $R(OOCR')_{n-i}(OH)_i$; wherein n is an integer having a value of at least 2, R is any aliphatic or cyclo-aliphatic hydrocarbyl group containing from about 2 to about 20 or more carbon atoms, R' is any branched aliphatic hydrocarbyl group having a carbon number in the range between about $C_4$ to $C_{12}$, and (i) is an integer having a value in the range between about 0 to n. Unless previously removed the polyol ester composition can also include excess $R(OH)_n$.

Optionally, the reaction product may comprise at least one linear acid, the linear acid being present in an amount of between about 1 to 80 wt. % based on the total amount of the branched mono-carboxylic acid. The linear acid is any linear saturated alkyl carboxylic acid having a carbon number in the range between about $C_2$ to $C_2$.

This novel synthetic polyol ester composition exhibits between about 20 to 200% or greater thermal/oxidative stability as measured by high pressure differential scanning, calorimetry versus a fully esterified composition which is also formed from the same branched or linear alcohol and the branched mono-carboxylic acid which have less than 10% unconverted hydroxyl groups, based on the total amount of hydroxyl groups in the branched or linear alcohol. The fully esterified synthetic polyol ester composition of the present invention typically has a hydroxyl number which is less than 5.

Optionally, an antioxidant is present in an amount of between about 0 to 5 mass %, based on the synthetic polyol ester composition. More preferably, between about 0.01 to 2.5 mass %.

The present invention also includes a lubricant which is prepared from at least one synthetic polyol ester composition having unconverted hydroxyl groups as set forth immediately above and a lubricant additive package. Additionally, a solvent may also be added to the lubricant, wherein the lubricant comprises about 60–99% by weight of the synthetic polyol ester composition, about 1 to 20% by weight the additive package, and about 0 to 20% by weight of the solvent.

The lubricant is preferably one selected from the group consisting of: crankcase engine oils, two-cycle engine oils, catapult oils, hydraulic fluids, drilling fluids, turbine oils, greases, compressor oils and functional fluids.

The additive package comprises at least one additive selected from the group consisting of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, and additive solubilizers.

Still other lubricants can be formed according to the present invention by blending this unique synthetic polyol ester composition and at least one additional base stock selected from the group consisting of: mineral oils, highly refined mineral oils, poly alpha olefins, polyalkylene glycols, phosphate esters, silicone oils, diesters and polyol esters. The synthetic polyol ester composition is blended with the additional base stocks in an amount between about 1 to 50 wt. %, based on the total blended base stock, preferably 1 to 25 wt. %, and most preferably 1 to 15 wt. %.

The present invention also involves a process for preparing a synthetic ester composition which comprises the steps of reacting a branched or linear alcohol with at least one branched acid, wherein the synthetic ester composition has between about 5–35% unconverted hydroxyl groups, based on the total amount of hydroxyl groups in the branched or linear alcohol, with or without an esterification catalyst, at a temperature in the range between about 140 to 250° C. and a pressure in the range between about 30 mm Hg to 760 mm Hg (3.999 to 101.308 kPa) for about 0.1 to 12 hours, preferably 2 to 8 hours. Optionally, the branched acid can be replaced with a mixture of branched and linear acids. The product is then treated in a contact process step by contacting it with a solid such as, for example, alumina, zeolite, activated carbon, clay, etc.

DESCRIPTION OF THE PREFERRED EMBODIMENTS

Figure 1:
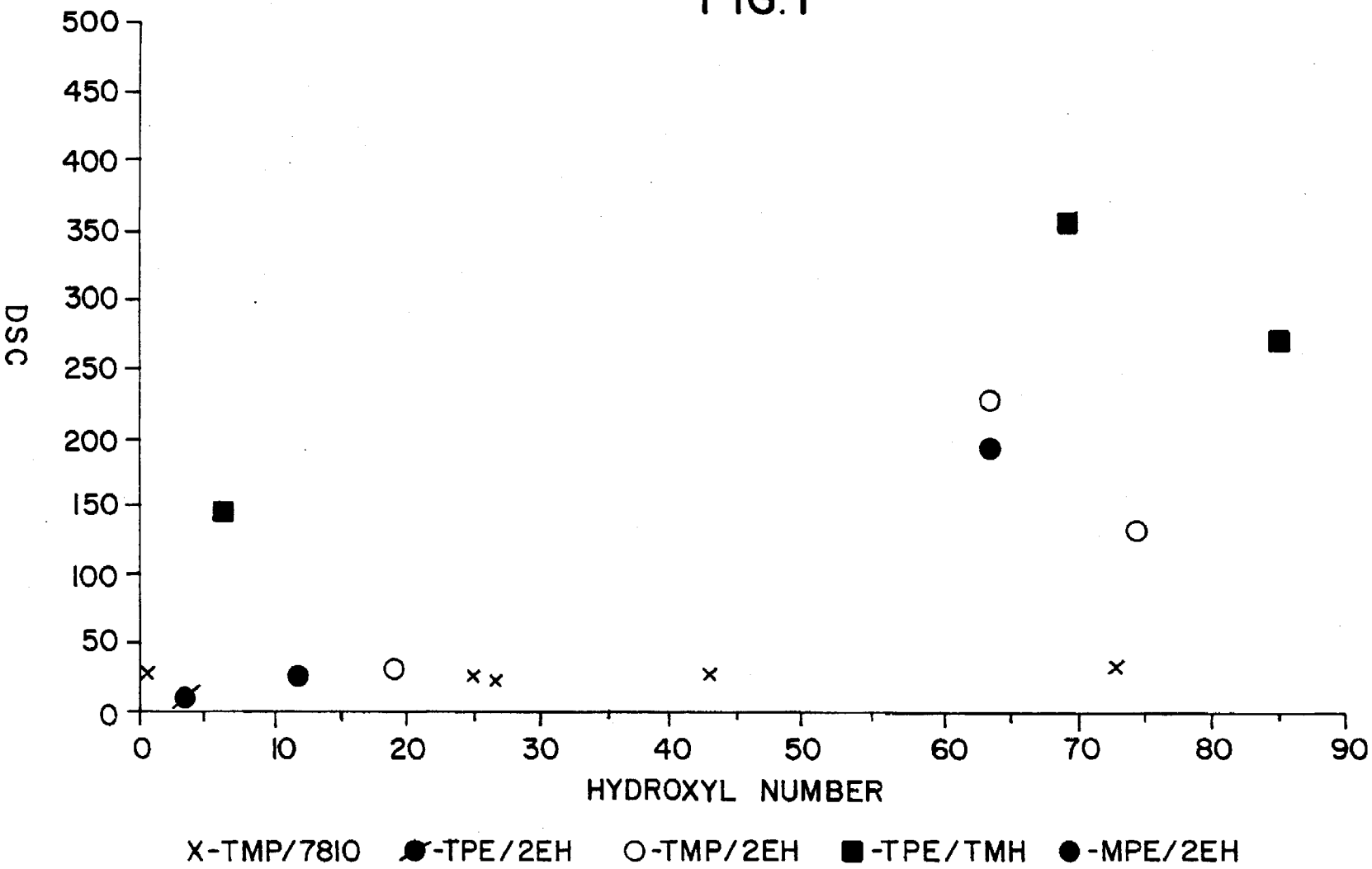
FIG. 1 is a graph plotting HPDSC results versus hydroxyl number for various polyol esters having unconverted hydroxyl groups bonded thereto.

The polyol ester composition of the present invention is preferably formed by reacting a polyhydroxyl compound with at least one branched acid. In the polyol ester composition, the polyol is preferably present in an excess of about 10 to 35 equivalent percent or more for the amount of acid used. The composition of the feed polyol is adjusted so as to provide the desired composition of the product ester.

The high hydroxyl esters formed in accordance with the present invention are typically resistant to high temperature oxidation with or without the use of conventional antioxidants such as V-81.

The acid is preferably a highly branched acid such that the unconverted hydroxyl groups which are bonded to the resultant ester composition act similarly to an antioxidant such that it transfers a hydrogen atom to the unstable carbon radical which is produced when the ester molecule is under thermal stress, thereby effecting a "healing" of the radical (i.e., convert the carbon radical to a stable alcohol and oxygen). These unconverted hydroxyl groups which act as internal antioxidants, can substantially reduce or, in some instances, eliminate the need for the addition of costly antioxidants to the polyol ester composition. Moreover, esters having unconverted hydroxyl groups bonded thereto demonstrate substantially enhanced thermal/oxidative stability versus esters having similar amounts of antioxidants admixed therewith.

The fact these polyol esters having unconverted hydroxyl groups also exhibit lower end friction coefficients and wear volume than similar fully esterified polyol esters, suggests that these polyol esters can also be used as antiwear agents or friction modifiers.

Alternatively, linear acids can be admixed with the branched acids in a ratio of between about 1:99 to 80:20 and thereafter reacted with the branched or linear alcohol as set forth immediately above. However, the same molar excess of alcohol used in the all branched case is also required in the mixed acids case such that the synthetic ester composition formed by reacting the alcohol and the mixed acids still has between about 5–35% unconverted hydroxyl groups, based on the total amount of hydroxyl groups in the alcohol.

The esterification reaction is preferably conducted, with or without a catalyst, at a temperature in the range between about 140° to 250° C. and a pressure in the range between about 30 mm Hg to 760 mm Hg (3.999 to 101.308 kPa) for about 0.1 to 12 hours, preferably 2 to 8 hours. The stoichiometry in the reactor is variable, with the capability of vacuum stripping excess acid to generate the preferred final composition.

If the esterification reaction is conducted under catalytic conditions, then the preferred esterification catalysts are titanium, zirconium and tin catalysts such as titanium, zirconium and tin alcoholates, carboxylates and chelates. Selected acid catalysts may also be used in this esterification process. See U.S. Pat. Nos. 5,324,853 (Jones et al.), which issued on Jun. 28, 1994, and 3,056,818 (Werber), which issued on Oct. 2, 1962, both of which are incorporated herein by reference.

ALCOHOLS

Among the alcohols which can be reacted with either the branched acid or branched and linear acid mixture are, by way of example, polyols (i.e., polyhydroxyl compounds) represented by the general formula:

$$R(OH)_n$$

wherein R is any aliphatic or cyclo-aliphatic hydrocarbyl group (preferably an alkyl) and n is at least 2. The hydrocarbyl group may contain from about 2 to about 20 or more carbon atoms, and the hydrocarbyl group may also contain substituents such as chlorine, nitrogen and/or oxygen atoms. The polyhydroxyl compounds generally may contain one or more oxyalkylene groups and, thus, the polyhydroxyl compounds include compounds such as polyetherpolyols. The number of carbon atoms (i.e., carbon number, wherein the term carbon number as used throughout this application refers to the total number of carbon atoms in either the acid or alcohol as the case may be) and number of hydroxy groups (i.e., hydroxyl number) contained in the polyhydroxyl compound used to form the carboxylic esters may vary over a wide range.

The following alcohols are particularly useful as polyols: neopentyl glycol, 2,2-dimethylol butane, trimethylol ethane, trimethylol propane, trimethylol butane, monopentaerythritol, technical grade pentaerythritol, di-pentaerythritol, tri-pentaerythritol, ethylene glycol, propylene glycol and polyalkylene glycols (e.g., polyethylene glycols, polypropylene glycols, 1,4-butanediol, sorbitol and the like, 2-methylpropanediol, polybutylene glycols, etc., and blends thereof such as a polymerized mixture of ethylene glycol and propylene glycol). The most preferred alcohols are technical grade (e.g., approximately 88% mono-, 10% di- and 1–2% tri-pentaerythritol) pentaerythritol, monopentaerythritol, di-pentaerythritol, neopentyl glycol and trimethylol propane.

BRANCHED ACIDS

The branched acid is preferably a mono-carboxylic acid which has a carbon number in the range between about $C_5$ to $C_{13}$, more preferably about $C_7$ to $C_{10}$ wherein methyl or ethyl branches are preferred. The mono-carboxylic acid is preferably at least one acid selected from the group consisting of: 2,2-dimethyl propionic acid (neopentanoic acid), neoheptanoic acid, neooctanoic acid, neononanoic acid, iso-hexanoic acid, neodecanoic acid, 2-ethyl hexanoic acid (2EH), 3,5,5-trimethyl hexanoic acid (TMH), isoheptanoic acid, isooctanoic acid, isononanoic acid and isodecanoic acid. One especially preferred branched acid is 3,5,5-trimethyl hexanoic acid. The term "neo" as used herein refers to a trialkyl acetic acid, i.e., an acid which is triply substituted at the alpha carbon with alkyl groups. These alkyl groups are equal to or greater than $CH_3$ as shown in the general structure set forth herebelow:

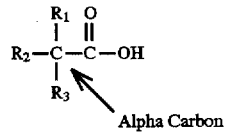

wherein $R_1$, $R_2$, and $R_3$ are greater than or equal to $CH_3$ and not equal to hydrogen.

3,5,5-trimethyl hexanoic acid has the structure set forth herebelow:

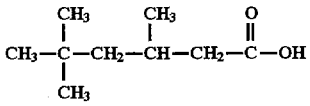

LINEAR ACIDS

The preferred mono- and/or di-carboxylic linear acids are any linear saturated alkyl carboxylic acid having a carbon number in the range between about $C_2$ to $C_{18}$, preferably $C_2$ to $C_{10}$.

Some examples of linear acids include acetic, propionic, pentanoic, heptanoic, octanoic, nonanoic, and decanoic acids. Selected polybasic acids include any $C_2$ to $C_{12}$ polybasic acids, e.g., adipic, azelaic, sebacic and dodecanedioic acids.

The process of synthesizing polyol ester compositions having significant unconverted hydroxyl groups according to the present invention typically follows the below equation:

$$R(OH)_n+R'COOH \rightarrow R(OH)_n+R(OOCR')_n+R(OOCR')_{n-1}OH$$

$$+R(OOCR')_{n-2}(OH)_2+R(OOCR')_{n-i}(OH)_i \quad \text{(Eq. 1)}$$

wherein n is an integer having a value of at least 2, R is any aliphatic or cyclo-aliphatic hydrocarbyl group containing from about 2 to about 20 or more carbon atoms and, optionally, substituents such as chlorine, nitrogen and/or oxygen atoms, and R' is any branched aliphatic hydrocarbyl group having a carbon number in the range between about $C_4$ to $C_{12}$, more preferably about $C_6$ to $C_9$, wherein methyl or ethyl branches are preferred, and (i) is an integer having a value of between about 0 to n.

The reaction product from Equation 1 above can either be used by itself as a lubricant base stock or in admixture with other base stocks, such as mineral oils, highly refined mineral oils, poly alpha olefins (PAO), polyalkylene glycols (PAG), phosphate esters, silicone oils, diesters and polyol esters. When blended with other base stocks, the partial ester composition according to the present invention is preferably present in an amount of from about 1 to 50 wt. %, based on the total blended base stock, more preferably between about 1 to 25 wt. %, and most preferably between about 1 to 15 wt. %.

The present invention also encompasses high hydroxyl complex esters which exhibit enhanced thermal/oxidative stability. Complex acid esters are made via the reaction of a polyol, a monocarboxylic acid, and a polybasic acid (such as adipic acid). Compared to typical polyol esters (i.e., polyol and monocarboxylic acid), complex acid esters have higher viscosities, due to the formation of dimers, trimers, and other oligomers. As with polyol esters, complex acid esters are typically prepared in a process that results in a high conversion of the polyol moieties. A measure of this conversion is given by hydroxyl number. As an example, polyol esters used in aviation turbine oils typically have hydroxyl numbers on the order of 5 mg KOH/g or less, indicating very high conversion. The present inventors have now discovered that incomplete or partial conversion of complex acid esters actually can result in a product that has greater thermal/oxidative stability, as measured by HPDSC, than do complex acid esters with low hydroxyl numbers.

Complex alcohol esters are made via the reaction of a polyol, a $C_6$–$C_{13}$ alcohol, and a monocarboxylic or polybasic acid. Compared to typical polyol esters (i.e., polyol and monocarboxylic acid), complex alcohol esters, similar complex acid ester, have higher viscosities. The present inventors have discovered that incomplete or partial conversion of complex alcohol esters actually can result in a product that has greater thermal/oxidative stability, as measured by HPDSC, than do complex acid esters with low hydroxyl numbers.

The polyol ester composition according to the present invention can be used in the formulation of various lubricants, such as, crankcase engine oils (i.e., passenger car motor oils, heavy duty diesel motor oils, and passenger car diesel oils), two-cycle engine oils, catapult oil, hydraulic fluids, drilling fluids, aircraft and other turbine oils, greases, compressor oils, functional fluids and other industrial and engine lubrication applications. The lubricating oils contemplated for use with the polyol ester compositions of the present invention include both mineral and synthetic hydrocarbon oils of lubricating viscosity and mixtures thereof with other synthetic oils. The synthetic hydrocarbon oils include long chain alkanes such as cetanes and olefin polymers such as oligomers of hexene, octene, decene, and dodecene, etc. The other synthetic oils include (1) fully esterified ester oils, with no free hydroxyls, such as pentaerythritol esters of monocarboxylic acids having 2 to 20 carbon atoms, trimethylol propane esters of monocarboxylic acids having 2 to 20 carbon atoms, (2) polyacetals and (3) siloxane fluids. Especially useful among the synthetic esters are those made from polycarboxylic acids and monohydric alcohols. More preferred are the ester fluids made by fully esterifying pentaerythritol, or mixtures thereof with di- and tri-pentaerythritol, with an aliphatic monocarboxylic acid containing from 1 to 20 carbon atoms, or mixtures of such acids.

In some of the lubricant formulations set forth above a solvent be employed depending upon the specific application. Solvents that can be used include the hydrocarbon solvents, such as toluene, benzene, xylene, and the like.

The formulated lubricant according to the present invention preferably comprises about 60–99% by weight of at least one polyol ester composition of the present invention, about 1 to 20% by weight lubricant additive package, and about 0 to 20% by weight of a solvent. Alternatively, the base stock could comprise 1–50 wt. % of at least one additional base stock selected from the group consisting of: mineral oils, highly refined mineral oils, alkylated mineral oils, poly alpha olefins, polyalkylene glycols, phosphate esters, silicone oils, diesters and polyol esters.

CRANKCASE LUBRICATING OILS

The polyol ester composition can be used in the formulation of crankcase lubricating oils (i.e., passenger car motor oils, heavy duty diesel motor oils, and passenger car diesel oils) for spark-ignited and compression-ignited engines. The additives listed below are typically used in such amounts so as to provide their normal attendant functions. Typical amounts for individual components are also set forth below. All the values listed are stated as mass percent active ingredient.

| ADDITIVE | MASS % (Broad) | MASS % (Preferred) |
|---|---|---|
| Ashless Dispersant | 0.1–20 | 1–8 |
| Metal detergents | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier | 0.01–6 | 0–4 |
| Synthetic and/or Mineral Base Stock | Balance | Balance |

The individual additives may be incorporated into a base stock in any convenient way. Thus, each of the components can be added directly to the base stock by dispersing or dissolving it in the base stock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into base stock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20 mass % and preferably 5 to 10 mass %, typically about 7 to 8 mass % of the concentrate or additive package with the remainder being base stock.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such a such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of base stocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Friction modifiers may be included to improve fuel economy. Oil-soluble alkoxylated mono- and di-amines are well known to improve boundary layer lubrication. The amines may be used as such or in the form of an adduct or reaction product with a boron compound such as a boric oxide, boron halide, metaborate, boric acid or a mono-, di- or tri-alkyl borate.

Other friction modifiers are known. Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and anhydrides with alkanols are described in U.S. Pat. No. 4,702,850. Examples of other conventional friction modifiers are described by M. Belzer in the "Journal of Tribology" (1992), Vol. 114, pp. 675–682 and M. Belzer and S. Jahanmir in "Lubrication Science" (1988), Vol. 1, pp. 3–26. One such example is organo-metallic molybdenum.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

TWO-CYCLE ENGINE OILS

The polyol ester composition can be used in the formulation of two-cycle engine oils together with selected lubricant additives. The preferred two-cycle engine oil is typically formulated using the polyol ester composition formed according to the present invention together with any conventional two-cycle engine oil additive package. The additives listed below are typically used in such amounts so as to provide their normal attendant functions. The additive package may include, but is not limited to, viscosity index improvers, corrosion inhibitors, oxidation inhibitors, coupling agents, dispersants, extreme pressure agents, color stabilizers, surfactants, diluents, detergents and rust inhibitors, pour point depressants, antifoaming agents, and anti-wear agents.

The two-cycle engine oil according to the present invention can employ typically about 75 to 85% base stock, about 1 to 5% solvent, with the remainder comprising an additive package.

Examples of the above additives for use in lubricants are set forth in the following documents which are incorporated herein by reference: U.S. Pat. No. 4,663,063 (Davis), which issued on May 5, 1987; U.S. Pat. No. 5,330,667 (Tiffany, III et al.), which issued on Jul. 19, 1994; U.S. Pat. No. 4,740,321 (Davis et al.), which issued on Apr. 26, 1988; U.S. Pat. No. 5,321,172 (Alexander et al.), which issued on Jun. 14, 1994; and U.S. Pat. No. 5,049,291 (Miyaji et al.), which issued on Sep. 17, 1991.

CATAPULT OILS

Catapults are instruments used on aircraft carriers at sea to eject the aircraft off of the carrier. The polyol ester composition can be used in the formulation of catapult oils together with selected lubricant additives. The preferred catapult oil is typically formulated using the polyol ester composition formed according to the present invention together with any conventional catapult oil additive package. The additives listed below are typically used in such amounts so as to provide their normal attendant functions. The additive package may include, but is not limited to, viscosity index improvers, corrosion inhibitors, oxidation inhibitors, extreme pressure agents, color stabilizers, detergents and rust inhibitors, antifoaming agents, anti-wear agents, and friction modifiers. These additives are disclosed in Klamann, "Lubricants and Related Products", *Verlag Chemie,* Deerfield Beach, Fla., 1984, which is incorporated herein by reference.

The catapult oil according to the present invention can employ typically about 90 to 99% base stock, with the remainder comprising an additive package.

HYDRAULIC FLUIDS

The polyol ester composition can be used in the formulation of hydraulic fluids together with selected lubricant additives. The preferred hydraulic fluids are typically formulated using the polyol ester composition formed according to the present invention together with any conventional hydraulic fluid additive package. The additives listed below are typically used in such amounts so as to provide their normal attendant functions. The additive package may include, but is not limited to, viscosity index improvers, corrosion inhibitors, boundary lubrication agents, demulsifiers, pour point depressants, and antifoaming agents.

The hydraulic fluid according to the present invention can employ typically about 90 to 99% base stock, with the remainder comprising an additive package.

Other additives are disclosed in U.S. Pat. No. 4,783,274 (Jokinen et al.), which issued on Nov. 8, 1988, and which is incorporated herein by reference.

DRILLING FLUIDS

The polyol ester composition can be used in the formulation of drilling fluids together with selected lubricant additives. The preferred drilling fluids are typically formulated using the polyol ester composition formed according to the present invention together with any conventional drilling fluid additive package. The additives listed below are typically used in such amounts so as to provide their normal attendant functions. The additive package may include, but is not limited to, viscosity index improvers, corrosion inhibitors, wetting agents, water loss improving agents, bactericides, and drill bit lubricants.

The drilling fluid according to the present invention can employ typically about 60 to 90% base stock and about 5 to 25% solvent, with the remainder comprising an additive package. See U.S. Pat. No. 4,382,002 (Walker et al), which issued on May 3, 1983, and which is incorporated herein by reference.

Suitable hydrocarbon solvents include: mineral oils, particularly those paraffin base oils of good oxidation stability with a boiling range of from 200–400° C. such as Mentor 28®, sold by Exxon Chemical Americas, Houston, Tex.; diesel and gas oils; and heavy aromatic naphtha.

TURBINE OILS

The polyol ester composition can be used in the formulation of turbine oils together with selected lubricant additives. The preferred turbine oil is typically formulated using the polyol ester composition formed according to the present invention together with any conventional turbine oil additive package. The additives listed below are typically used in such amounts so as to provide their normal attendant functions. The additive package may include, but is not limited to, viscosity index improvers, corrosion inhibitors, oxidation inhibitors, thickeners, dispersants, anti-emulsifying agents, color stabilizers, detergents and rust inhibitors, and pour point depressants.

The turbine oil according to the present invention can employ typically about 65 to 75% base stock and about 5 to 30% solvent, with the remainder comprising an additive package, typically in the range between about 0.01 to about 5.0 weight percent each, based on the total weight of the composition.

GREASES

The polyol ester composition can be used in the formulation of greases together with selected lubricant additives. The main ingredient found in greases is the thickening agent or gellant and differences in grease formulations have often involved this ingredient. Besides, the thickener or gellants, other properties and characteristics of greases can be influenced by the particular lubricating base stock and the various additives that can be used.

The preferred greases are typically formulated using the polyol ester composition formed according to the present invention together with any conventional grease additive package. The additives listed below are typically used in such amounts so as to provide their normal attendant functions. The additive package may include, but is not limited to, viscosity index improvers, oxidation inhibitors, extreme pressure agents, detergents and rust inhibitors, pour point depressants, metal deactivators, anti-wear agents, and thickeners or gellants.

The grease according to the present invention can employ typically about 80 to 95% base stock and about 5 to 20% thickening agent or gellant, with the remainder comprising an additive package.

Typical thickening agents used in grease formulations include the alkali metal soaps, clays, polymers, asbestos, carbon black, silica gels, polyureas and aluminum complexes. Soap thickened greases are the most popular with lithium and calcium soaps being most common. Simple soap greases are formed from the alkali metal salts of long chain fatty acids with lithium 12-hydroxystearate, the predominant one formed from 12-hydroxystearic acid, lithium hydroxide monohydrate and mineral oil. Complex soap greases are also in common use and comprise metal salts of a mixture of organic acids. One typical complex soap grease found in use today is a complex lithium soap grease prepared from 12-hydroxystearic acid, lithium hydroxide monohydrate, azelaic acid and mineral oil. The lithium soaps are described and exemplified in may patents including U.S. Pat. No. 3,758,407 (Harting), which issued on Sep. 11, 1973; U.S. Pat. No. 3,791,973 (Gilani), which issued on Feb. 12, 1974; and U.S. Pat. No. 3,929,651 (Murray), which issued on Dec. 30, 1975, all of which are incorporated herein by reference together with U.S. Pat. No. 4,392,967 (Alexander), which issued on Jul. 12, 1983.

A description of the additives used in greases may be found in Boner, "Modern Lubricating Greases", 1976, Chapter 5, which is incorporated herein by reference, as well as additives listed above in the other products.

COMPRESSOR OILS

The polyol ester composition can be used in the formulation of compressor oils together with selected lubricant additives. The preferred compressor oil is typically formulated using the polyol ester composition formed according to the present invention together with any conventional compressor oil additive package. The additives listed below are typically used in such amounts so as to provide their normal attendant functions. The additive package may include, but is not limited to, oxidation inhibitors, additive solubilizers, rust inhibitors/metal passivators, demulsifying agents, and anti-wear agents.

The compressor oil according to the present invention can employ typically about 80 to 99% base stock and about 1 to 15% solvent, with the remainder comprising an additive package.

The additives for compressor oils are also set forth in U.S. Pat. No. 5,156,759 (Culpon, Jr.), which issued on Oct. 20, 1992, and which is incorporated herein by reference.

It is extremely important in many lubricant applications such as aircraft turbine oils to provide a lubricant product which is thermally/oxidatively stable. One means of measuring relative thermal/oxidative stability in lubricants is via high pressure differential scanning calorimetry (HPDSC). In this test, the sample is heated to a fixed temperature and held there under a pressure of air (or oxygen) and the time to onset of decomposition is measured. The longer the time to decomposition, the more stable the sample. In all cases described hereafter, the conditions are as follows unless specifically noted otherwise: 220° C., 3.445 MPa (500 psi) air (i.e., 0.689 MPa (100 psi) oxygen and 2.756 MPa (400 psi) nitrogen), and the addition of 0.5 wt. % dioctyl diphenyl amine (Vanlube-81®) as an antioxidant.

The unique polyol esters having unconverted hydroxyl groups according to the present invention have also been shown to exhibit high polarity which the present inventors have found to be very important in reducing friction and wear effects in crackcase engines.

The novel polyol ester having unconverted hydroxyl groups according to the present invention also exhibits greatly enhanced fuel savings versus either no ester additive or fully esterified synthetic esters. The percent fuel savings is typically on the order of 2 to 2.5% for 5W40 oils, as measured by the Sequence VI Screener Test. The percent fuel savings will vary along with the viscosity of the oils tested.

EXAMPLE 1

For comparative purposes, Table 1 below demonstrates the enhanced thermal/oxidative performance of polyol ester compositions which do not have unconverted hydroxyl groups disposed about the carbon chain thereof versus conventional non-polyol esters.

TABLE 1

| Sample Number | Ester | HPDSC Decomposition Time, Min. |
|---|---|---|
| 1 | TMP/$C_7$/$C_9$/TMH | 23.9 |
| 2 | TMP/$C_7$/C810 | 23.4 |
| 3 | Diisoheptyl Adipate | 11.6 |
| 4 | Diisooctyl Adipate | 9.7 |
| 5 | Diisodecyl Adipate | 6.0 |
| 6 | Ditridecyl Adipate | 3.9 |

TABLE 1-continued

| Sample Number | Ester | HPDSC Decomposition Time, Min. |
|---|---|---|
| 7 | Diisooctyl Phthalate | 8.0 |
| 8 | Ditridecyl Phthalate | 10.2 |

TMP denotes trimethylol propane.
$C_7$ is a linear $C_7$ acid.
$C_9$ is a linear $C_9$ acid.
TMH is 3,5,5-trimethyl hexanoic acid.
C810 is a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.

The data set forth below in Table 2 indicate that there is considerable room for improving the thermal/oxidative performance of polyol esters as measured by the HPDSC test. In particular, it should be noted that esters of 3,5,5-trimethyl hexanoic acid and 2,2-dimethylpropionic acid (i.e., neopentanoic (neo$C_5$)) are particularly stable under the HPDSC test.

TABLE 2

| Sample Number | Ester | HPDSC Decomposition Time, Min. |
|---|---|---|
| 9 | TMP/n-$C_9$ | 14.2 |
| 10 | TechPE/n-$C_9$ | 14.7 |
| 11 | TMP/TMH | 119 |
| 12 | TechPE/TMH | 148 |
| 13 | MPE/TMH | 143 |
| 14 | TMP/n-$C_5$ | 51.9 |
| 15 | 50% TMP/TMH and 50% TMP/n-$C_5$ | 65.7 |
| 16 | MPE/TMH/neo-$C_5$ | 168 |

n-$C_9$ is a linear normal $C_9$ acid.
TechPE is technical grade pentaerythritol (i.e., 88% mono-, 10% di- and 1–2% tri-pentaerythritol).
MPE is mono-pentaerythritol.
n-$C_5$ is a linear normal $C_5$ acid.
TMH is 3,5,5-trimethyl hexanoic acid.
neo-$C_5$ is 2,2-dimethyl propionic acid.

A polyol ester having unconverted hydroxyl groups disposed thereon was formed using technical grade pentaerythritol and 3,5,5-trimethyl hexanoic acid (Sample 18) by mixing, about 225% molar equivalents of 3,5,5-trimethyl hexanoic acid with each mole of technical grade pentaerythritol. This was compared in Table 3 below with a conventional polyol ester formed from technical grade pentaerythritol and 3,5,5-trimethyl hexanoic acid (Sample 17) prepared using an excess of 3,5,5-trimethyl hexanoic acid.

TABLE 3

| Sample Number | Ester | HPDSC Decomposition Time, Min. |
|---|---|---|
| 17 | TechPE/TMH | 148 |
| 18 | TechPE/TMH w/ 25% unconverted OH | 468 |

TechPE is technical grade pentaerythritol (i.e., about 88% mono-, 10% di- and 1–2% tri-pentaerythritol).
TMH is 3,5,5-trimethyl hexanoic acid.

The data set forth above in Tables 1–3 support the discovery by the present inventors that certain compositions of polyol esters which contain at least 5 mole % unconverted hydroxyl (OH) groups have surprisingly enhanced thermal/oxidative stability as measured by high pressure differential scanning calorimetry (HPDSC) versus conventional polyol and non-polyol esters.

EXAMPLE 2

Certain polyol esters containing at least 5 mole % unconverted hydroxyl groups show dramatic enhancements in thermal/oxidative performance in the HPDSC test when compared to polyol esters of trimethylol propane and a linear acid (7810). These esters contain specific types of branching and the enhancement is seen for both trimethylol propane (TMP) and pentaerythritol (both mono grade and technical grade) esters. Table 4 below summarizes the results obtained by the present inventors.

TABLE 4

| Sample Number | Ester | Hydroxyl No. | HPDSC Decomposition Time, Min. |
|---|---|---|---|
| 1 | TMP/2EH | 20 | 30.1 |
| 2 | TMP/2EH | 64.0 | 225.3 |
| 3 | TMP/2EH | 75.0 | 125.3 |
| 4 | MPE/2EH | 12.1 | 24.4 |
| 5 | MPE/2EH | 63.8 | 183.5 |
| 6 | TechPE/2EH | 3.6 | 17.5 |
| 7 | TechPE/TMH | <10 | 148 |
| 8 | TechPE/TMH | 86 | 268 |
| 9 | TechPE/TMH | 68.5 | 364 |
| 10 | TechPE/TMH | >50 | 468 |
| 11 | TMP/7810 | 0.2 | 26.1 |
| 12 | TMP/7810 | 25.7 | 21.3 |
| 13 | TMP/7810 | 26.8 | 22.9 |
| 14 | TMP/7810 | 43.5 | 21.3 |
| 15 | TMP/7810 | 73.8 | 26.5 |

Hydroxyl Number is measured in mg KOH/gram sample using a conventional near infrared technique.
2EH is 2 ethyl hexanoic acid.
TechPE is technical grade pentaerythritol (i.e., 88% mono-, 10% di- and 1–2% tri-pentaerythritol).
MPE is mono-pentaerythritol.
TMH is 3,5,5-trimethyl hexanoic acid.
TMP is trimethylol propane.
7810 is a blend of 37 mole % of a n-$C_7$ acid and 63 mole % of a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.

The results set forth above in Table 4 and FIG. 1 demonstrate that when all of the initially added antioxidant (Vanlube®-81) is consumed, the ester radicals are not healed and true decomposition occurs rapidly as shown in sample numbers 1, 4 and 6 which have small amounts of unconverted hydroxyl groups, as well in the polyol esters formed from linear acids regardless of amount of unconverted hydroxyl groups present (see samples numbers 11–15). With certain branched esters such as sample numbers 2, 3, and 6–10 above, the unconverted hydroxyl group (i.e., the only molecular change from the full ester) is capable of transferring its hydrogen to the first formed radical so as to created a more stable radical, thereby acting as an additional antioxidant. With the linear acid esters set forth above in sample numbers 11–15, the internal radical generated from transfer of a hydrogen from an unconverted hydroxyl group is not significantly more stable than the initially formed carbon radical, thereby yielding essentially no change in decomposition time. The results from Table 4 above are graphically depicted in FIG. 1 attached hereto.

EXAMPLE 3

The data set forth below in Table 5 demonstrate that polyol ester compositions having unconverted hydroxyl groups which are formed from polyols and branched acids in accordance with the present invention exhibit internal antioxidant properties.

TABLE 5

| Sample Number | Ester | Hydroxyl Number | HPDSC Decomposition Time, Min. |
|---|---|---|---|
| 1 | TechPE/TMH | greater than 50 | 468 with 0.5% V-81 |
| 2 | TechPE/TMH | greater than 50 | 58.3 with no V-81 |
| 3 | TechPE/L9 | less than 5 | 16.9 with 0.5% V-81 |
| 4 | TechPE/TMH | less than 5 | 148 with 0.5% V-81 |
| 5 | TechPE/TMH | less than 5 | 3.14 with no V-81 |

V-81 is dioctyl diphenyl amine.
TechPE is technical grade pentaerythritol (i.e., 88% mono-, 10% di- and 1–2% tri-pentaerythritol).
TMH is 3,5,5-trimethyl hexanoic acid.
L9 is blend of 62–70 mole % linear $C_9$ acid and 30–38 mole % branched $C_9$ acid.

The results in Table 5 above demonstrate that polyol esters with unconverted hydroxyl groups (i.e., sample numbers 1 and 2) greatly enhance the oxidative induction time of the lubricant formulation versus conventional polyol esters which do not have any significant amount of free or unconverted hydroxyl groups. Moreover, combining these unique polyol esters with an antioxidant such as V-81 significantly extends the time required for decomposition (see sample no. 1). Although the time for decomposition was reduced when this polyol ester did not include any added antioxidant, it still took approximately 3½ times longer to decompose versus a conventional $C_9$ acid polyol ester which had an antioxidant additive (i.e., 58.3 minutes (sample 2) versus 16.9 minutes (sample 3)). Furthermore, Samples 4 and 5 demonstrate that decomposition of the polyol ester compositions having a hydroxyl number less than 5 occurs much more rapidly compared to polyol ester compositions of the same acid and polyol having a hydroxyl number greater than 50 (e.g., Samples 1 and 2) regardless of whether or not an antioxidant is admixed with the respective polyol ester composition. This clearly demonstrates that synthesizing a polyol ester composition having unconverted hydroxyl groups disposed about the carbon chain of the polyol ester provide enhanced thermal/oxidative stability to the resultant product, as measured by HPDSC. Finally, a comparison of Sample Nos. 2 and 5, wherein no antioxidant was used, clearly establishes the antioxidant properties of the polyol ester of technical grade pentaerythritol and 3,5,5-trimethyl hexanoic acid having substantial amounts of unconverted hydroxyl group bonded which has an HPDSC of 58.3 minutes versus the same polyol ester with little or no unconverted hydroxyl groups which has an HPDSC of 3.14 minutes.

EXAMPLE 4

Data set forth below in Table 6 demonstrate that polyol esters with unconverted hydroxyl groups (i.e., unconverted hydroxyl groups) formed from polyols and branched acids according to the present invention are also capable of enhancing the thermal/oxidative stability when blended with other hydrocarbon base stocks such as poly alpha olefins (PAO).

TABLE 6

| Sample Number | Base Stock Composition | Hydroxyl Number* | HPDSC Decomposition Time, Min.** |
|---|---|---|---|
| 1 | PAO6 | | 10.65 |
| 2 | 95% PAO6 and 5% TMP/7810 | <5 | 12.99 |
| 3 | 90% PAO6 and 10% TMP/7810 | <5 | 13.49 |
| 4 | 75% PAO6 and 25% TMP/7810 | <5 | 18.30 |
| 5 | 95% PAO6 and 5% TechPE/TMH | <5 | 12.89 |
| 6 | 90% PAO6 and 10% TechPE/TMH | <5 | 13.52 |
| 7 | 75% PAO6 and 25% TechPE/TMH | <5 | 17.03 |
| 8 | 95% PAO6 and 5% MPE/2EH | 63.8 | 18.19 |
| 9 | 90% PAO6 and 10% MPE/2EH | 63.8 | 28.75 |
| 10 | 95% PAO6 and 5% MPE/TMH | 68.5 | 22.57 |
| 11 | 90% PAO6 and 10% MPE/TMH | 68.5 | 53.68 |
| 12 | 75% PAO6 and 25% MPE/TMH | 68.5 | 108.86 |

PAO6 is a 1-decene oligomer.
*Hydroxyl Number is measured in mg KOH/gram sample and is the hydroxyl number of the ester-containing portion of the blend.
**Denotes that the HPDSC measurement was conducted at 190° C. and 3.445 MPa in the presence of 0.5% Vanlube ®-81 additive (i.e., dioctyl diphenyl amine).
2EH is 2 ethyl hexanoic acid.
TechPE is technical grade pentaerythritol (i.e., 88% mono-, 10% di- and 1–2% tri-pentaerythritol).
MPE is mono-pentaerythritol.
TMH is 3,5,5-trimethyl hexanoic acid.
TMP is trimethylol propane.
7810 is a blend of 37 mole % of a n-$C_7$ acid and 63 mole % of a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.

Figure 2:
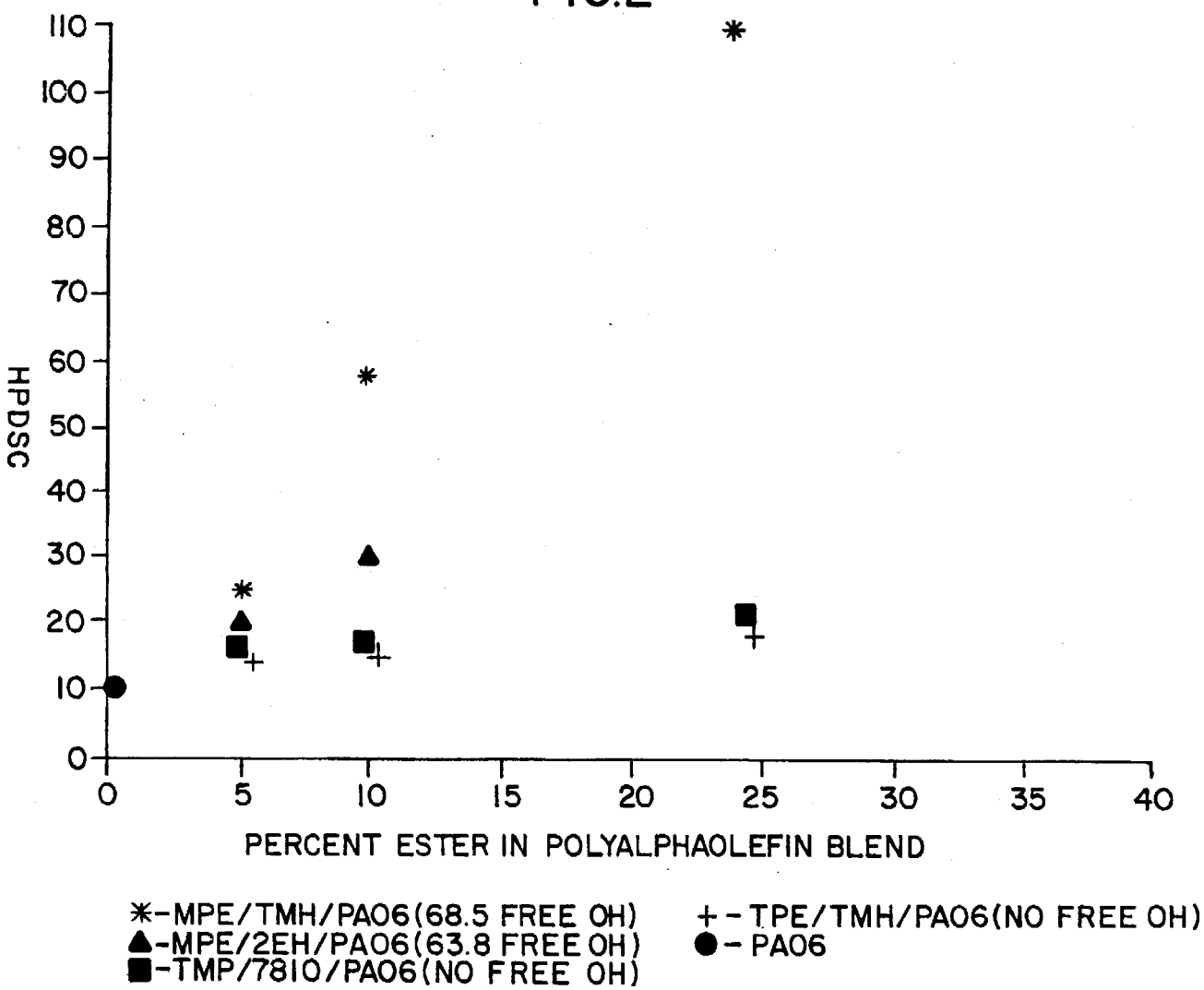
FIG. 2 is a graph plotting HPDSC results versus percent of various esters blended with polyalpha olefin (PAO)

The results set forth above in Table 6 and FIG. 2 demonstrate that polyol ester compositions with at least 10% unconverted hydroxyl content (i.e., sample numbers 8–12) bring about enhanced thermal/oxidative stability as measured by HPDSC when blended with hydrocarbon base stocks such as poly alpha olefins.

EXAMPLE 5

Data set forth below in Table 7 demonstrate that polyol esters with unconverted hydroxyl groups formed from polyols and branched acids according to the present invention and which have been admixed with 0.5% Vanlube® 81 (an antioxidant) are capable of retarding the onset of thermal/oxidative degradation as measured by HPDSC. The below samples where run at 3.445 MPa (500 psi) air (i.e., 0.689 MPa (100 psi) oxygen and 2.756 MPa (400 psi) nitrogen.

TABLE 7

| Sample | Hydrocarbon | Ester | Ratio | Temp. (°C.) | Hydroxyl Number | HPDSC (minutes) |
|---|---|---|---|---|---|---|
| 1 | SN150 | MPE/2EH | 95/5 | 190 | 63.5 | 14.53 |
| 2 | SN150 | MPE/2EH | 90/10 | 190 | 63.5 | 22.41 |
| 3 | SN150 | MPE/2EH | 75/25 | 190 | 63.5 | 31.94 |
| 4 | SN150 | MPE/TMH | 95/5 | 190 | 68.5 | 16.98 |
| 5 | SN150 | MPE/TMH | 90/10 | 190 | 68.5 | 17.58 |
| 6 | SN150 | MPE/TMH | 75/25 | 190 | 68.5 | 57.18 |

SN150 is a low sulfur, neutralized, saturated, linear hydrocarbon having between 14 to 34 carbon atoms.
TMH is 3,5,5-trimethyl hexanoic acid.
2EH is 2 ethyl hexanoic acid.
MPE is monopentaerythritol

EXAMPLE 6

Figure 3:
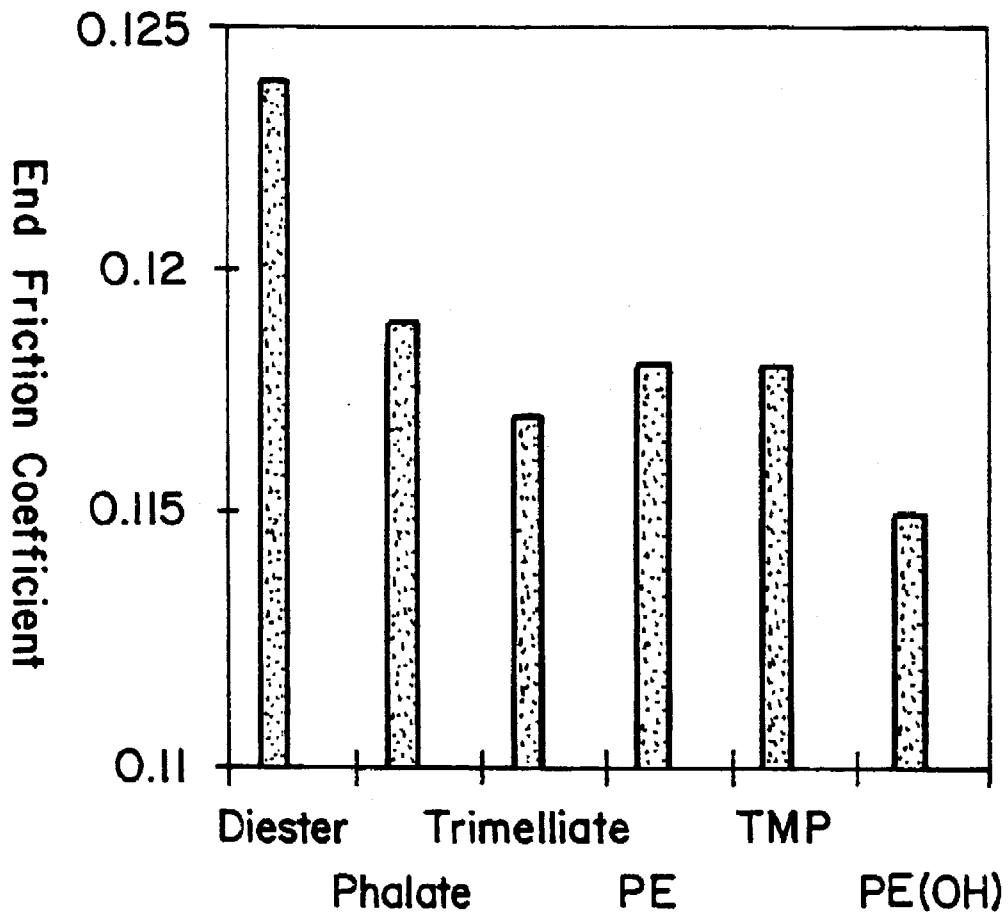
FIG. 3 is a graph plotting various esters formed with 3,5,5-trimethylhexanoic acid versus friction coefficient.
Figure 4:
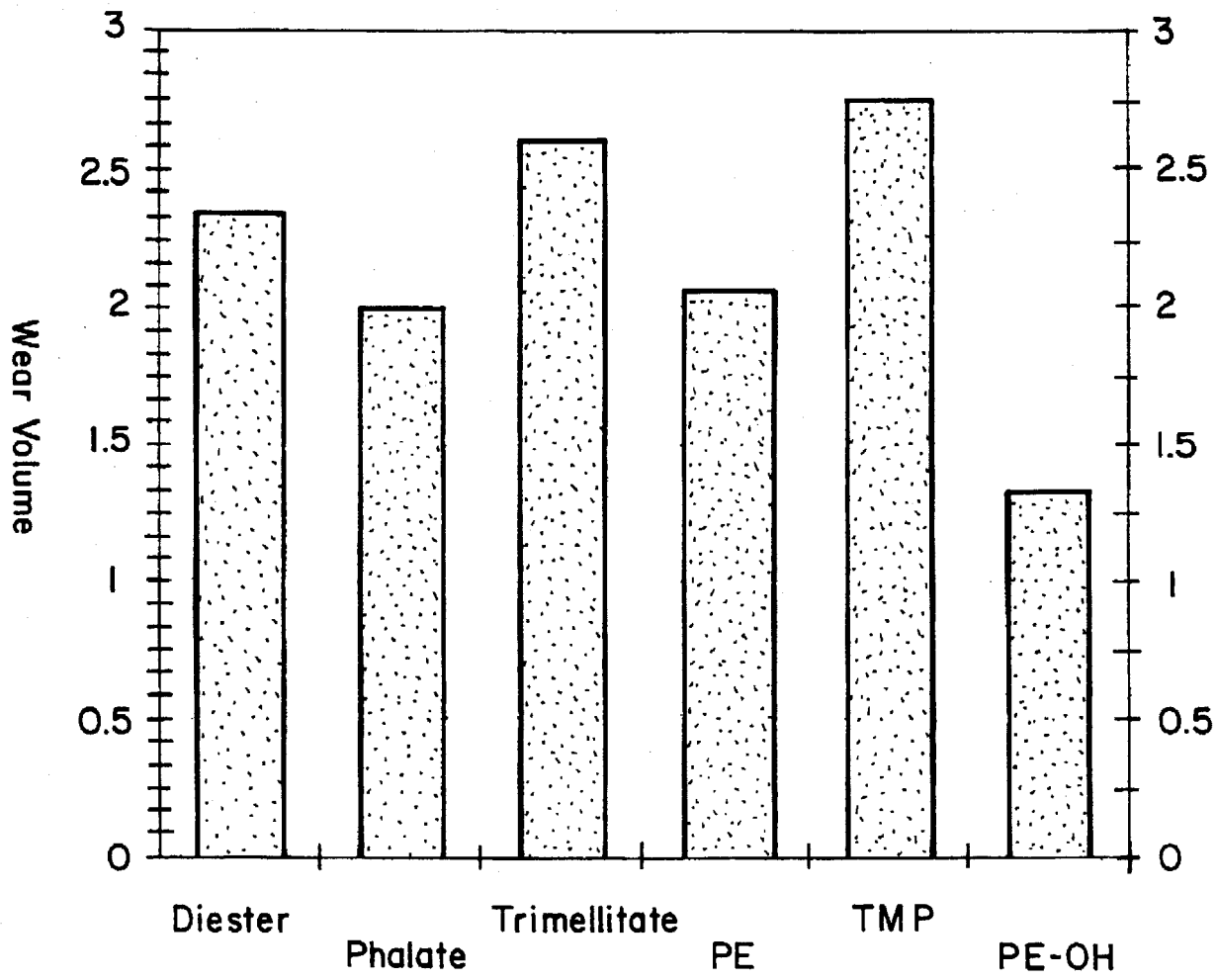
FIG. 4 is a graph plotting various esters formed with 3,5,5-trimethylhexanoic acid versus wear volume.
Figure 5:
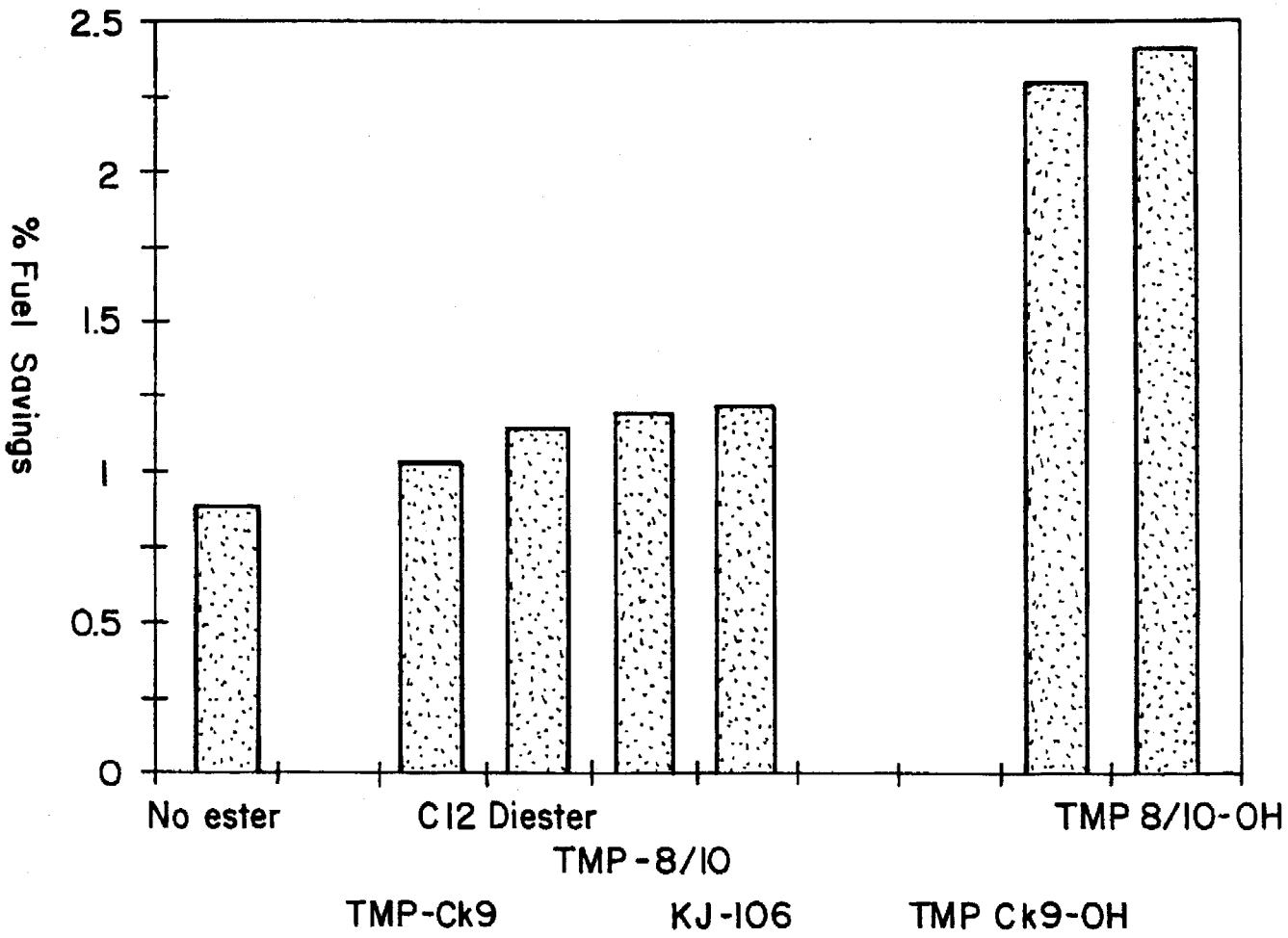
FIG. 5 is a graph plotting percent fuel savings versus various esters from a Sequence VI Screener-Engine fuel efficiency test.

The below esters all formed with 3,5,5-methylhexanoic acid (Cekanoic 9 acid) show improved performance. For example, the mono-hydroxyl pentaerythritol having a significant level of unreacted hydroxyl groups exhibited the lowest level of friction (i.e., 0.115) and wear volume (i.e., 1.35) versus other fully esterified synthetic esters. The formulations were tested in a Falex Block-on-Ring (BOR) tribometer at 100° C. with a 220 lb. load, a speed of 420 rpm (0.77 m/s), and a two hour test length. Friction coefficients are reported as end of run value. The end of run values show relative standard deviations (1σ) of approximately 1.5%. Following the testing, wear volumes are determined by multiple scan profilometry. For a Superflo QC sample the relative standard deviation (1σ) is approximately 12%. The results are set forth below in Table 8 and in the attached FIGS. 3 and 4:

TABLE 8

| Ester | End Friction | Wear Volume |
|---|---|---|
| Diester | 0.1245 | 2.35 |
| Phthalate | 0.1195 | 2.00 |
| Trimellitate | 0.1175 | 2.65 |
| Technical grade pentaerythritol ester | 0.1180 | 2.10 |
| Trimethylolpropane ester | 0.1180 | 2.75 |
| Technical grade pentaerythritol ester w/ unconverted (OH) | 0.1150 | 1.35 |

EXAMPLE 7

Several different high hydroxyl number esters and non-esters were tested at 10% levels in fully formulated oils both in a Sequence VI Screener test which is essentially a shortened version of the Sequence VI Screener test showed superior fuel economy performance as compared to either non-ester containing formulations and to similar low hydroxyl number ester formulations.

TABLE 9

| Ester | % Fuel Savings |
|---|---|
| None* | 0.80 |
| TMP/Ck9 | 1.04 |
| $C_{12}$/diester | 1.15 |
| TMP/C810 | 1.21 |
| KJ-106 | 1.23 |
| TMP/Ck9 (OH)** | 2.31 |
| TMP/C810 (OH)*** | 2.42 |

TMP denotes trimethylol propane
Ck9 is tri-3,5,5-trimethylhexanoic acid
C810 is a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.
KJ-106 is Ketjenlube 106 which is an oligomeric product formed from 1-decene, maleic anhydride and butanol.
*denotes polyalphaolefin.
**denotes a partial ester formed from TMP and Ck9 wherein 25% of the hydroxyl groups are unconverted.
***denotes a partial ester formed from TMP and C810 wherein 25% of the hydroxyl groups are unconverted.

As demonstrated in Table 9, above, the synthetic esters with unconverted hydroxyl groups according to the present invention unexpectedly exhibited substantially greater fuel savings than many conventional fully esterified ester base stocks and poly alpha olefins.

EXAMPLE 8

In a Falex Block-on-Ring Tribometer, the addition of 10 wt. % levels of the high hydroxyl ester according to the present invention, i.e., trimethylol propane and C810 ester having approximately 25% unconverted hydroxyl groups, showed significant benefit in both friction and wear performance as compared to either non-ester containing formulations or as compared to the addition of other low hydroxyl number ester (i.e, 5 or less)

A small number of oils were formulated in S150N (i.e., a low sulfur, neutralized, saturated, linear hydrocarbon having between 14 to 34 carbon atoms) using the Ultron DI (detergent inhibitor) additive package as well as 8% treat of Shellvis 251. Formulations were generated both with and without 100 ppm molybdenum (as MV82 a commercial MoDTC) using three esters of varying "polarity"; di-iso-tridecyl adipate, trimethylol propane octanoate/decanoate, and TMP8/10(OH) (i.e., a high hydroxyl ester comprising trimethylol propane and a C810 acid having, about one hydroxyl group per molecule of TMP8/10 left unconverted). In addition, 10% "top-treats" of S150N and the TMP8/10 (OH) high hydroxyl ester in a 1995 10W-30 SuperFlo were also tested. Table 10 below present the formulations used in the following tables:

TABLE 10

| Sample | Formulation |
|---|---|
| S150N-Euro Package | S150N + 8% Shellvis 251 + Ultron DI |
| Euro + di-iso-tridecyl adipate | S150N + 8% Shellvis 251 + ULTRON DI + 10% di-iso-tridecyl adipate |
| Euro + TMP octanoate/decanoate | S150N + 8% Shellvis 251 + ULTRON DI + 10% trimethylol propane octanoate/decanoate |
| Euro + TMP8/10 (OH) | S150N + 8% Shellvis 251 + ULTRON DI + 10% TMP8/10 (OH) |
| 5150N-Ultron (M) | S150N + 8% Shellvis 251 + ULTRON DI (M) |
| Euro + di-iso-tridecyl adipate (M) | S150N + 8% Shellvis 251 + ULTRON DI (M) + di-iso-tridecyl adipate |
| Euro + TMP octanoate/decanoate(M) | S150N + 8% Shellvis 251 + ULTRON DI (M) + 10% trimethylol propane octanoate/decanoate |
| Euro + TMP8/10(OH) (M) | S150N + 8% Shellvis 251 + ULTRON DI (M) + 10% TMP8/10 (OH) |
| SF(95) | Commercial 1995 10W30 SuperFlo |
| SF + S150N | SF10W30(95) + 10% S150N |
| SF + TMP8/10(OH) | SF10W30 + 10% TMP8/10 (OH) |

(M) denotes that 100 ppm of molybdenum was present as MoDTC (molybdenum dithiocarbamate)

Figure 6:
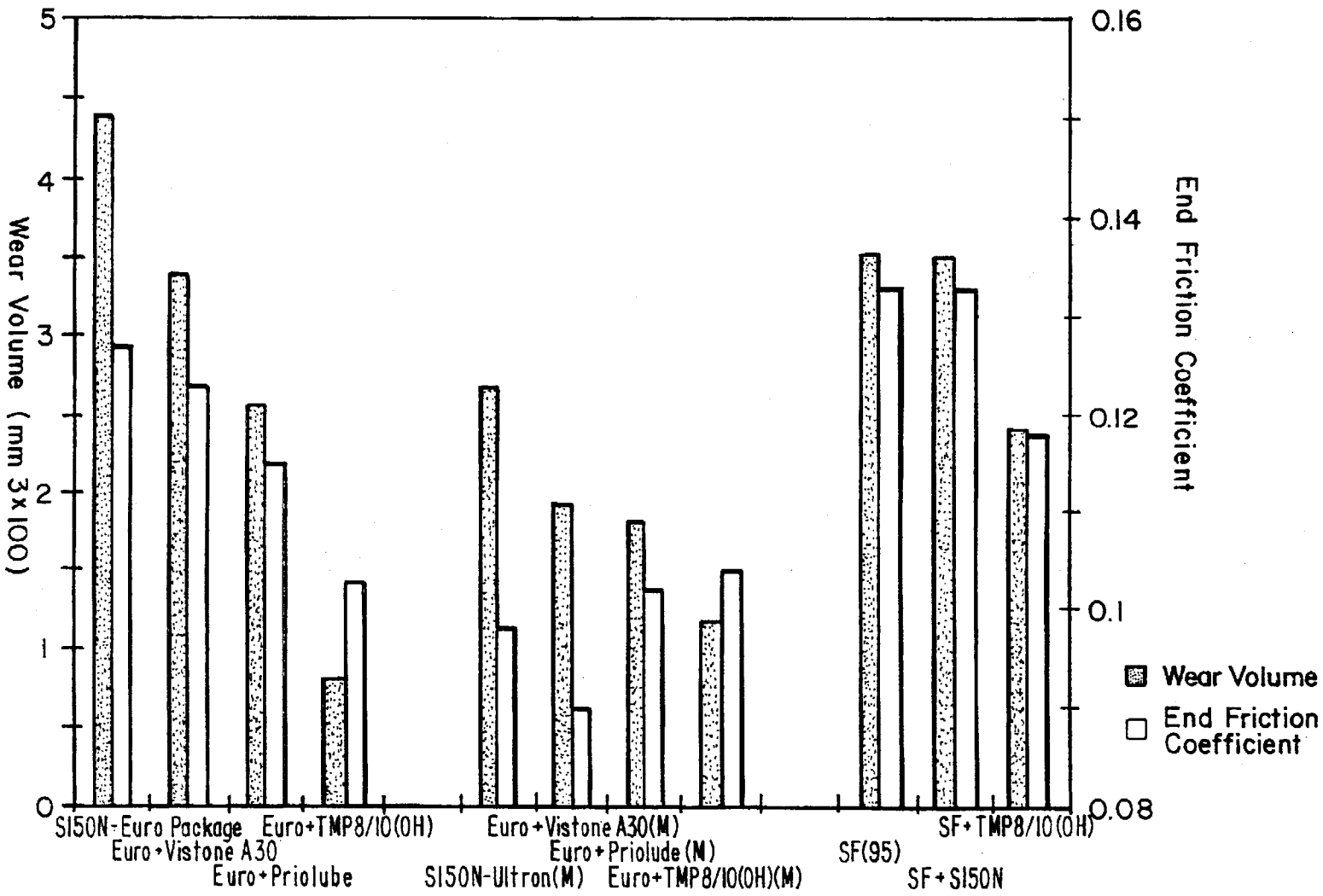
FIG. 6 is a graph plotting, both wear volume and end friction coefficient versus various base stocks blended with synthetic lubricants and with or without molybdenum.

The formulations above were tested in a Falex Block-on-Ring tribometer at 100° C. with a 220 lb. (99.8 kg) load, a speed of 420 rpm (0.77 m/s), and a two hour test length. Friction coefficients are reported as end of run value. The end of run values shows relative standard deviations (1σ) of approximately 1.5%. Following the testing, wear volumes are determined by multiple scan profilometry. For a Super-Flo QC sample the relative standard deviation (1σ) is approximately 12%. The results are set forth below in Table 11 and attached FIG. 6.

TABLE 11

| Sample No. | Wear Volume | End Friction Coefficient |
|---|---|---|
| S150N-Euro Package | 4.41 | 0.127 |
| Euro + di-iso-tridecyl adipate | 3.39 | 0.123 |
| Euro + TMPoctanoate/decanoate | 2.57 | 0.115 |
| Euro + TMP8/10 (OH) | 0.81 | 0.103 |
| S150N-Ultron (M) | 2.68 | 0.098 |
| Euro + di-iso-tridecyl adipate (M) | 1.93 | 0.090 |
| Euro + TMP octanoate/decanoate(M) | 1.83 | 0.102 |
| Euro + TMP8/10 (OH) (M) | 1.17 | 0.104 |
| SF(95) | 3.53 | 0.133 |

TABLE 11-continued

| Sample No. | Wear Volume | End Friction Coefficient |
|---|---|---|
| SF + S150N | 3.51 | 0.118 |
| SF + TMP8/10 (OH) | 2.42 | 0.118 |

S150N is a low sulfur, neutralized, saturated, linear hydrocarbon having between 14 to 34 carbon atoms.
C810 is a mixture of 3–5 mole % n-$C_6$ acid, 48–58 mole % n-$C_8$ acid, 36–42 mole % n-$C_{10}$ acid, and 0.5–1.0 mole % n-$C_{12}$ acid.
TMP8/10 denotes an ester formed from trimethylol propane and C810 acids, wherein the resultant ester has 25% unconverted hydroxyl groups.

The Euro-TMP8/10(OH) samples set forth above demonstrated significant beneficial wear volume and end friction coefficient effects versus other lubricant formulations that did not have a 10% component made of the high hydroxyl ester according to the present invention. Even in the presence of molybdenum, the high hydroxyl ester provides substantial antiwear benefit versus the base case with molybdenum.

EXAMPLE 9

In order to determine if the addition of a high hydroxyl number ester would provide benefit when added to a formulated mineral oil at a concentration of 1%, two oils were tested in the Falex Block-on-Ring, tribometer. The base case oil, designated as SETI (i.e., small engine test instrument) Standard Oil is a fully formulated mineral-based oil with a somewhat reduced phosphorous content (such as ZDDP) of approximately 0.06%. To this oil was added 1% by wt. of TMP/C810 (OH) made according to the present invention. An eddy current distance sensor was used to determined wear rates at 12 conditions of each oil while friction coefficients were also determined. The results, shown below in Table 12, demonstrate the improvement in both wear and friction performance obtained by the addition of only 1% of the high hydroxyl number ester. The precision of the wear measurement is ±0.2 microns/hour which allows the appearance of negative wear rates in some cases of very slow wear.

TABLE 12

| | Conditions | | SETI Standard Oil | | SETI Standard Oil +1% C8/C10 TMP-OH | |
|---|---|---|---|---|---|---|
| Oil Temp. °C. | Speed (rpm) | Load (lbs.) | Wear rate (μ/hour) | Friction coeffic. | Wear rate (μ/hour) | Friction Coeffic. |
| 60 | 105 | 110 | 0.03 | 0.122 | −0.18 | 0.122 |
| 60 | 105 | 220 | 0.15 | 0.140 | −0.12 | 0.130 |
| 60 | 420 | 110 | 0.14 | 0.097 | 0.11 | 0.095 |
| 60 | 420 | 220 | 1.86 | 0.137 | 0.32 | 0.120 |
| 100 | 105 | 110 | 0.08 | 0.138 | −0.14 | 0.120 |
| 100 | 105 | 220 | 0.41 | 0.141 | −0.01 | 0.123 |
| 100 | 420 | 110 | 0.62 | 0.132 | 0.09 | 0.107 |
| 100 | 420 | 220 | 2.01 | 0.136 | 0.20 | 0.116 |
| 140 | 105 | 110 | 0.33 | 0.137 | 0.02 | 0.115 |
| 140 | 105 | 220 | 0.38 | 0.137 | −0.15 | 0.115 |
| 140 | 420 | 110 | 1.33 | 0.131 | 0.18 | 0.113 |
| 140 | 420 | 220 | 2.54 | 0.132 | 0.68 | 0.111 |

EXAMPLE 10

The following complex acid esters were prepared wherein the hydroxyl number was adjusted between fully and partial esters. From the data set forth below in Table 13, it can be seen that lower conversions, i.e., hydroxyl numbers greater than 10 mg KOH/g, result in higher thermal/oxidative stability as measured by PDSC.

TABLE 13

| Complex Acid Ester | OH Number (mg KOH/g) | HPDSC (min.) |
|---|---|---|
| TMP + adipic acid + Ck9 | 4.77 | 29.30 |
| TMP + adipic acid + Ck9 | 43.50 | 61.07 |
| TMP + adipic acid + Ck9 | 65.20 | 75.53 |
| TPE + adipic acid + Ck9 | 6.58 | 35.96 |
| TPE + adipic acid + Ck9 | 27.28 | 79.49 |
| TPE + adipic acid + Ck9 | 61.52 | 105.97 |

TMP denotes trimethylol propane
TPE denotes technical grade pentaerythritol
Ck9 denotes 3,5,5-trimethylhexanoic acid.

While we have shown and described several embodiments in accordance with our invention, it is to be clearly understood that the same are susceptible to numerous changes apparent to one skilled in the art. Therefore, we do not wish to be limited to the details shown and described but intend to show all changes and modifications which come within the scope of the appended claims.

We claim:

1. A synthetic ester composition exhibiting thermal and oxidative stability which comprises the reaction product of:

a branched or linear alcohol having the general formula $R(OH)_n$, wherein R is an aliphatic or cyclo-aliphatic group having from about 2 to 20 carbon atoms and n is at least 2; and at least one linear mono-carboxylic acid which has a carbon number in the range between about $C_2$ to $C_{12}$; wherein said synthetic ester composition has between about 5–35% unconverted hydroxyl groups, based on the total amount of hydroxyl groups in said branched or linear alcohol.

2. The synthetic ester composition according to claim 1 wherein said linear acid is present in an amount of between about 1 to 80 wt. % based on the total amount of said branched mono-carboxylic acid.

3. The synthetic ester composition according to claim 1 wherein said synthetic ester composition exhibits between about 20 to 200 % higher thermal/oxidative stability as measured by high pressure differential scanning calorimetry versus a fully esterified composition.

4. The synthetic ester composition according to claim 1 wherein said synthetic ester composition has a hydroxyl number which is at least 20.

5. The synthetic ester composition according to claim 1 further comprising an antioxidant in an amount between about 0 to 5 mass %, based on said synthetic ester composition.

6. The synthetic ester composition according to claim 5 wherein said antioxidant is present in an amount of between about 0.01 to 2.5 mass %, based on said synthetic ester composition.

7. The synthetic ester composition according to claim 5 wherein said antioxidant is an arylamine.

8. The synthetic ester composition according to claim 7 wherein said arylamine is either dioctyl phenylamine or phenylalphanaphthylamine.

9. The synthetic ester composition according to claim 1 wherein said branched or linear alcohol is selected from the group consisting of neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol, polyalkylene glycols, 1,4-butanediol, sorbitol, glycerol, and 2-methylpropanediol.

10. The synthetic ester composition according to claim 1 wherein said linear acid is at least one acid selected from the group consisting of: acetic acid, propionic acid, pentanoic acid, heptanoic acid, octanoic acid, nonanoic acid, and decanoic acid.

11. A synthetic ester composition exhibiting thermal and oxidative stability which comprises the reaction product of:

a branched or linear alcohol having the general formula $R(OH)_n$, wherein R is an aliphatic or cyclo-aliphatic group having from about 2 to 20 carbon atoms and n is at least 2;

at least one monocarboxylic acid, and at least one polybasic acid; wherein said synthetic ester composition has between about 5–35% unconverted hydroxyl groups, based on the total amount of hydroxyl groups in said branched or linear alcohol, thereby forming a complex acid ester.

12. A synthetic ester composition exhibiting thermal and oxidative stability which comprises the reaction product of:

a branched or linear alcohol having the general formula $R(OH)_n$, wherein R is an aliphatic or cyclo-aliphatic group having from about 2 to 20 carbon atoms and n is at least 2;

monohydric alcohol; and at least one polybasic acid; wherein said synthetic ester composition has between about 5–35% unconverted hydroxyl groups, based on the total amount of hydroxyl groups in said branched or linear alcohol, thereby forming a complex alcohol ester.

13. A lubricant which is prepared from:

at least one synthetic ester composition exhibiting thermal and oxidative stability which comprises the reaction product of a branched or linear alcohol having the general formula $R(OH)_n$, wherein R is an aliphatic or cyclo-aliphatic group having from about 2 to 20 carbon atoms and n is at least 2, and at least one branched mono-carboxylic acid which has a carbon number in the range between about $C_5$ to $C_{13}$; wherein said synthetic ester composition has between about 5–35% unconverted hydroxyl groups, based on the total amount of hydroxyl groups in said branched or linear alcohol;

at least one additional base stock selected from the group consisting of: mineral oils, highly refined mineral oils, alkylated mineral oils, poly alpha olefins, polyalkylene glycols, phosphate esters, silicone oils, diesters and polyol esters; and a lubricant additive package; whereby a fuel economy savings of at least about 2 relative percent is obtained versus lubricants formed without said synthetic ester.

14. The lubricant according to claim 13 wherein between about 50 to 90% of the hydroxyl groups from said branched or linear alcohol are converted upon the esterification of said branched or linear alcohol with said branched mono-carboxylic acid.

15. The lubricant according to claim 13 wherein said reaction product also comprises at least one linear acid, said linear acid being present in an amount of between about 1 to 80 wt. % based on the total amount of said branched mono-carboxylic acid.

16. The lubricant according to claim 15 wherein said linear acid is any linear saturated alkyl carboxylic acid having a carbon number in the range between about $C_2$ to $C_{12}$.

17. The lubricant according to claim 13 wherein said synthetic ester composition exhibits between about 20 to 200% higher thermal/oxidative stability as measured by high pressure differential scanning calorimetry versus a fully esterified composition formed from said branched or linear alcohol and said branched mono-carboxylic acid which have less than 10% unconverted hydroxyl groups, based on the total amount of hydroxyl groups in said branched or linear alcohol.

18. The lubricant according to claim 13 wherein said synthetic ester composition has a hydroxyl number which is at least 20.

19. The lubricant according to claim 13 further comprising an antioxidant in an amount between about 0 to 5 mass %, based on said synthetic ester composition.

20. The lubricant according to claim 19 wherein said antioxidant is present in an amount of between about 0.01 to 2.5 mass %, based on said synthetic ester composition.

21. The lubricant according to claim 20 wherein said antioxidant is an arylamine.

22. The lubricant according to claim 21 wherein said arylamine is selected from the group consisting of: dioctyl phenylamine, phenylalphanaphthylamine and heavier oligomeric arylamines.

23. The lubricant according to claim 13 wherein said branched acids are any mono-carboxylic acid which have a carbon number in the range between about $C_5$ to $C_{10}$.

24. The lubricant according to claim 16 wherein said linear acids are any linear saturated alkyl carboxylic acid having a carbon number in the range between about $C_2$ to $C_7$.

25. The lubricant according to claim 13 wherein said branched or linear alcohol is selected from the group consisting of: neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol, polyalkylene glycols, 1,4-butanediol, sorbitol, glycerol, and 2-methylpropanediol.

26. The lubricant according to claim 13 wherein said branched acid is at least one acid selected from the group consisting of: 2,2-dimethyl propionic acid, neoheptanoic acid, neooctanoic acid, neononanoic acid, iso-hexanoic acid, neodecanoic acid, 2-ethyl hexanoic acid, 3,5,5-trimethyl hexanoic acid, isoheptanoic acid, isooctanoic acid, isononanoic acid and isodecanoic acid.

27. The lubricant according to claim 16 wherein said linear acid is at least one acid selected from the group consisting of: acetic acid, propionic acid, pentanoic acid, heptanoic acid, octanoic acid, nonanoic acid, and decanoic acid.

28. The lubricant according to claim 16 wherein said linear acid is at least one polybasic acid selected from the group consisting of: adipic acid, azelaic acid, sebacic acid and dodecanedioic acid.

29. The lubricant according to claim 13 wherein said synthetic ester composition is blended with said additional base stocks in an amount between about 1 to 50 wt. %, based on the total blended base stock.

30. The lubricant according to claim 13 wherein said additive package comprises at least one additive selected from the group consisting of: viscosity index improvers, corrosion inhibitors, oxidation inhibitors, dispersants, lube oil flow improvers, detergents and rust inhibitors, pour point depressants, anti-foaming agents, anti-wear agents, seal swellants, friction modifiers, extreme pressure agents, color stabilizers, demulsifiers, wetting agents, water loss improving agents, bactericides, drill bit lubricants, thickeners or gellants, anti-emulsifying agents, metal deactivators, coupling agents, surfactants, and additive solubilizers.

31. The lubricant according to claim 13 further comprising a solvent.

32. The lubricant according to claim 31 wherein said lubricant comprises about 60–99% by weight of said synthetic ester composition, about 1 to 20% by weight said additive package, and about 0 to 20% by weight of said solvent.

33. The lubricant according to claim 13 wherein said synthetic ester is blended with either mineral oils or another synthetic ester.

34. The lubricant according to claim 13 wherein said synthetic ester composition further comprises a polybasic acid, thereby forming, a complex acid ester.

35. The lubricant according to claim 13 wherein said synthetic ester composition further comprises a second alcohol, thereby forming a complex alcohol ester.

36. The lubricant according to claim 13 wherein said lubricant is selected from the group consisting of: two-cycle engine oil formulations, catapult oil formulations, hydraulic fluid formulations, drilling, fluid formulations, turbine oil formulations, grease formulations, and compressor oil formulations.

37. A crankcase lubricating oil formulation which is prepared from:

at least one synthetic ester composition exhibiting thermal and oxidative stability which comprises the reaction product of: a branched or linear alcohol having the general formula $R(OH)_n$, wherein R is an aliphatic or cyclo-aliphatic group having from about 2 to 20 carbon atoms and n is at least 2, and at least one linear mono-carboxylic acid which has a carbon number in the range between about $C_2$ to $C_{12}$; wherein said synthetic ester composition has between about 5–35% unconverted hydroxyl groups, based on the total amount of hydroxyl groups in said branched or linear alcohol; and a lubricant additive package.

38. The formulation according to claim 37 wherein said additive package comprises at least one additive selected from the group consisting of: ashless dispersants, metal detergents, corrosion inhibitors, metal dihydrocarbyl dithiophosphates, anti-oxidants, pour point depressants, anti-foaming agents, anti-wear agents, friction modifiers, and viscosity modifiers.

39. The lubricant according to claim 13 wherein said synthetic ester is blended with at least one additional base stock such that a fuel economy savings of about 2 relative percent is obtained versus lubricants formed without said synthetic ester.

40. The lubricant according to claim 39 wherein said synthetic ester is added to said lubricant in an amount of between about 5–25 wt. %.

41. The lubricant according to claim 25 wherein said branched or linear alcohol is trimethylol propane.

42. The lubricant according to claim 41 wherein said mono-carboxylic acid is either 3,5,5-trimethylhexanoic acid or a linear acid comprising a mixture of about 3–5 mole % n-$C_6$ acid, about 48–58 mole % n-$C_8$ acid, about 36–42 mole % n-$C_{10}$ acid, and about 0.5–1.0 mole % n-$C_{12}$ acid.

43. The lubricant according to claim 42 wherein said mono-carboxylic acid is 3,5,5-trimethylhexanoic acid such that said lubricant exhibits a fuel economy savings of greater than about 1.04%.

44. The lubricant according to claim 42 wherein said mono-carboxylic acid is a linear acid comprising a mixture of about 3–5 mole % n-$C_6$ acid, about 48–58 mole % n-$C_8$ acid, about 36–42 mole % n-$C_{10}$ acid, and about 0.5–1.0 mole % n-$C_{12}$ acid such that said lubricant exhibits a fuel economy savings of greater than about 1.21%.

45. The synthetic ester composition according to claim 9 wherein said branched or linear alcohol is trimethylol propane and said linear acid comprising a mixture of n-$C_6$ acid, n-$C_8$ acid, n-$C_{10}$ acid, and n-$C_{12}$ acid.

46. The synthetic ester composition according to claim 45 wherein said linear acid comprises a mixture of about 3–5 mole % n-$C_6$ acid, about 48–58 mole % n-$C_8$ acid, about 36–42 mole % n-$C_{10}$ acid, and about 0.5–1.0 mole % n-$C_{12}$ acid.

* * * * *